US006151858A

United States Patent [19]

Ruiz et al.

[11] Patent Number: 6,151,858

[45] Date of Patent: Nov. 28, 2000

[54] BUILDING CONSTRUCTION SYSTEM

[75] Inventors: Antonio Reyes Ruiz, Lakeside; William E. Reilly, Yorba Linda, both of Calif.

[73] Assignees: Simple Building Systems, Spring Valley, Calif.; Joe Kariakin, Keizer, Oreg.

[21] Appl. No.: 09/286,926

[22] Filed: Apr. 6, 1999

[51] Int. Cl.[7] ..... E04C 2/34

[52] U.S. Cl. ..... 52/481.1; 52/344; 52/356; 52/351; 52/601

[58] Field of Search ..... 52/344, 356, 351, 52/481.1, 601, 600

[56] References Cited

U.S. PATENT DOCUMENTS

| | | | |
|---|---|---|---|
| 1,414,111 | 4/1922 | Burson . | |
| 1,685,247 | 9/1928 | Selway . | |
| 3,270,472 | 9/1966 | Gilbert | 52/348 |
| 4,472,919 | 9/1984 | Nourse | 52/601 |
| 4,590,717 | 5/1986 | Ruiz et al. . | |
| 4,602,467 | 7/1986 | Schilger . | |
| 4,885,884 | 12/1989 | Schilger . | |
| 5,414,972 | 5/1995 | Ruiz et al. . | |

*Primary Examiner*—Beth A. Stephan
*Assistant Examiner*—Patrick J. Chavez
*Attorney, Agent, or Firm*—Gene Scott-Patent Law & Venture Group

[57] ABSTRACT

A construction system uses an elongate horizontal structural beam having a vertically oriented pair of side legs integrally joined to a base plate. The base plate lays abutting a structural ground surface with the side legs extending upwardly. The structural beam further comprising a number of horizontally spaced apart, tabs extending outwardly from the side legs. A number of elongate vertical structural beams, act as wall bearing members and have, integrally joined to a further base plate, a further pair of side legs adapted for abutting, at a first end, the first structural beam. Further tabs extend outwardly from the further side legs. Each of the tabs is derived as a cut-out portion of the side legs such that a major surface area of the tabs is positioned vertically or horizontally depending upon how the beam is positioned. A vertical concrete wall abuts the first and the second side legs and is positioned for enclosing all of the tabs for attachment of the beams to the wall. In the case that the concrete wall comprises a rebar network, individual bars are placed and spaced apart within the concrete wall so as to avoid interference with the tabs.

4 Claims, 1 Drawing Sheet

BUILDING CONSTRUCTION SYSTEM

BACKGROUND OF THE INVENTION

1. Field of the Invention

This invention relates generally to building construction technique, and more particularly to a building construction system and method of use for preparing building walls of greater strength and resistance to ground motion.

2. Description of Related Art

The following art defines the present state of this field:

Schilger, U.S. Pat. No. 4,602,467 describes a building panel which can be used for either walls or floors. It comprises a thin shell unit of reinforced, monolithic cement material having a large, planar outer face and an inner face interconnected by parallel end edges and parallel side edges. A plurality of stud members are partially embedded in the inner face of the cement shell, these stud members being parallel to each other laterally spaced from each other and being fabricated of about 15 to 25 gauge galvanized steel sheet. This steel sheet material is shaped to provide a web portion with one longitudinal edge of the web being shaped to lock the stud within the concrete shell and the longitudinal edge of the web remote from the concrete shell comprising an L-shaped flange defining the outer surface of the stud member to which a finished panel may be attached. Channel-shaped metal beam members connect the ends of the studs.

Schilger, U.S. Pat. No. 4,885,884 describes a panel used as a building component. It comprises: (a) a plurality of C-shaped sheet steel channel beams each having a central web and an inner and outer edge flange, said inner flanges having cuts therein at longitudinally spaced locations to form upwardly projecting lugs and said beam members being parallel to each other and laterally spaced from each other; (b) form work panel members resting on the outer faces of the inner flanges and extending between the beams, said form work panel members being held against said flanges by parts of said projecting lugs being bent around the edges thereof, with the remaining lug portions projecting outwardly between adjacent form work panels and (c) a thin shell reinforced cement panel formed on said form work panels with said remaining projecting lug portions being embedded in the cement material, thereby forming a reinforced building component.

Ruiz et al., U.S. Pat. No. 4,590,717 describes a structural building module having first and second upright cast structural members. Each of the first and second structural upright members include a wall portion and a roof portion. These structural members are initially supported on erection pads such that the wall portions are upright and the roof portions project toward one another such that the roof portions can be joined together. After joining the roof portions a structural base is forming in situ by casting. The structural base is attached to the wall portions of the structural members by entraining into the structural base, attaching members projecting out of the wall portions near their edge.

Ruiz et al., U.S. Pat. No. 5,414,972 describes a reinforced structural member for connection to a building panel, such as a prefabricated building panel used to construct walls, floors and roofs of a building. The reinforced structural member is a two-piece assembly comprising a structural member and a reinforcing member. The reinforcing member is fastened to the structural member such that a plurality of projections extending from the reinforcing member engage the building panel. The reinforced structural member is especially adapted for use with composite or cement materials, such as concrete. The reinforcing member substantially reinforces the structural member, while the projections of the reinforcing member securely embed within the concrete building panel. A U-shaped track, having projections which embed within the building panel, also may be used to brace the reinforced structural members relative to each other and to the building panel.

The prior art teaches wall construction systems and methods. However, the prior art does not teach that such a wall system may be constructed so as to efficiently transfer force and movement between major elements of the structure. The present invention fulfills these needs and provides further related advantages as described in the following summary.

SUMMARY OF THE INVENTION

The present invention teaches certain benefits in construction and use which give rise to the objectives described below.

The present invention comprises a construction system which uses an elongate horizontal structural beam having a vertically oriented pair of side legs integrally joined to a base plate. The base plate lays abutting a structural ground surface with the side legs extending upwardly. The structural beam further comprising a number of horizontally spaced apart, tabs extending outwardly from the side legs. A number of elongate vertical structural beams, act as wall bearing members and have, integrally joined to a further base plate, a further pair of side legs adapted for abutting, at a first end, the first structural beam. Further tabs extend outwardly from the further side legs. Each of the tabs is derived as a cut-out portion of the side legs such that a major surface area of the tabs is positioned vertically or horizontally depending upon how the beam is positioned. A vertical concrete wall abuts the first and the second side legs and is positioned for enclosing all of the tabs for attachment of the beams to the wall. In the case that the concrete wall comprises a rebar network, individual bars are placed and spaced apart within the concrete wall so as to avoid interference with the tabs.

A primary objective of the present invention is to provide a building construction having advantages not taught by the prior art.

Another objective is to provide such a construction tying base beams and wall beams (studs) into concrete walls in such a manner that horizontal movement of the ground is effectively transferred to the horizontal beams, and vertical ground movement is effectively transferred to the vertical beams.

A further objective is to provide such a construction that is inexpensive to manufacture and assemble and yet highly effective in providing force transfer between building elements.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing FIGURE illustrates the present invention. In such drawing

DETAILED DESCRIPTION OF THE INVENTION

Figure 1:
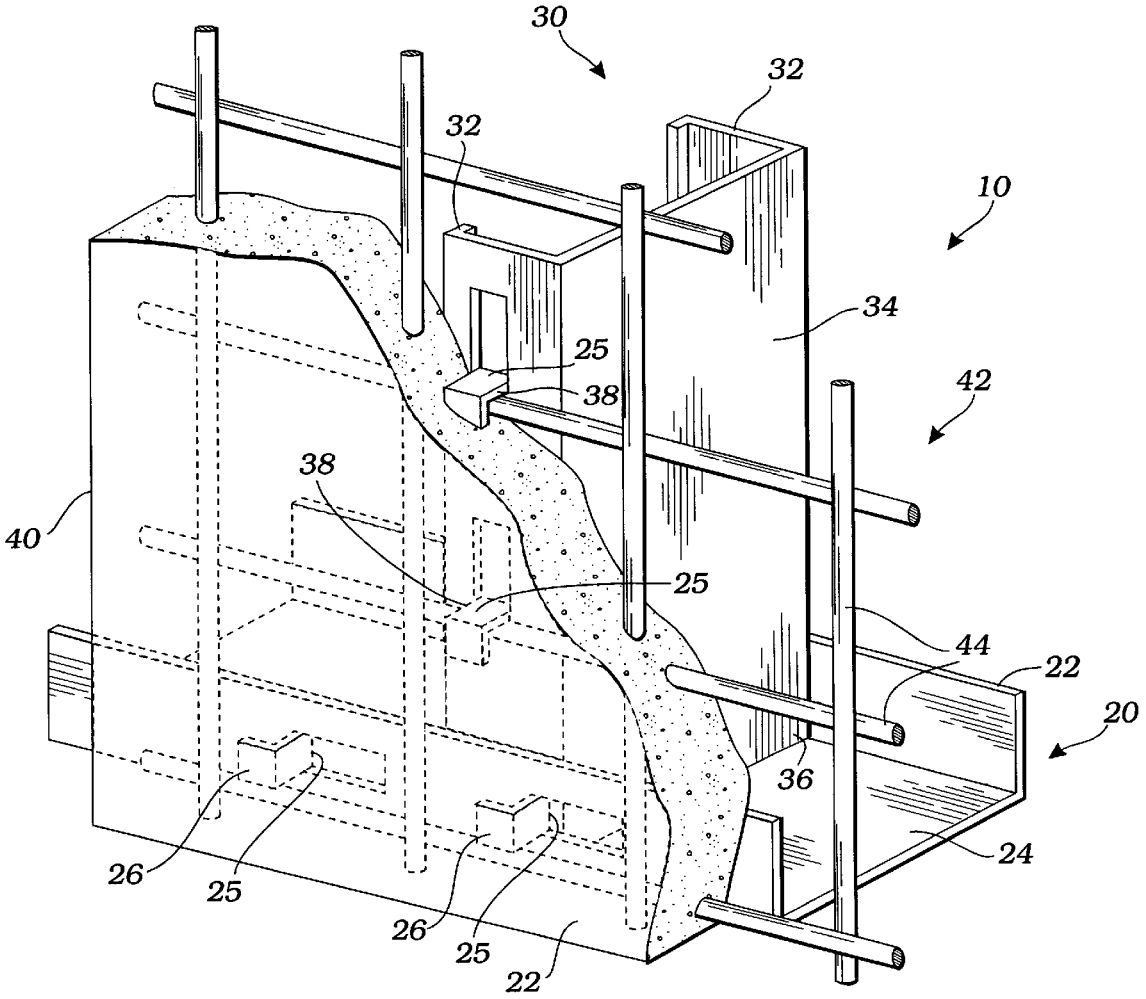
FIG. 1 is a partial cutaway perspective view of the preferred embodiment of the present invention.

The above described drawing FIGURE illustrates the invention, a construction system apparatus 10 comprising an elongate horizontal first structural means 20, preferably a rigid steel beam comprising a vertically oriented first side leg means 22, preferably a pair of flange-like legs, as shown in FIG. 1, integrally joined to a first base plate means 24, preferably a flat plate, the base plate means 24 adapted, by its flatness and positional orientation, for abutting a structural ground surface (not shown). The ground surface may be a concrete pad or other construction weight bearing foundation surface. The first side leg means 22 extend upwardly from the base plate means 24. Inventively, a plurality of horizontally spaced apart, first tab means 26 extend outwardly from the first side leg means 22. An elongate vertical second structural means 30 comprising preferably, a series of vertical beams (only one of which is shown in FIG. 1), wherein each provides a second side leg means 32 integrally joined to a second base plate means 34, wherein each of the second structural means 30 is adapted by its size and physical orientation for abutting, at a first end thereof 36, the first base plate means 24 and the first side leg means 22. Inventively, the second side leg means 32 provides a plurality of vertically spaced apart, second tab means 38 extending outwardly therefrom and generally of the size and shape of the first tab means 26. Each of the tab means 26, 38 are inventively derived as a cut-out portion of the first and the second side leg means 22, 32 respectively such that a major surface area of the first tab means is positioned vertically and a major surface area of the second tab means is positioned horizontally. In the present invention the tab means are folded out from the side wall means along a bend line 25 that is generally at right angles to the longitudinal axis of each of the beams. A vertical concrete wall 40 abuts the first and the second side leg means 22, 32 and is positioned for enclosing the first and the second tab means 21, 31 within the wall. Inventively, the first and second tab means 21, 31 are L-shaped such that the tabs are physically locked within the concrete wall 40. Inventively, the first and second structural means 20, 30 are U-shaped so as to be light in weight, yet strong, and are sized so that the vertically oriented beams are able to fit into and between the legs of the horizontal beams. In the case wherein the concrete wall 40 comprises a rebar network 42, the rebar network comprising a plurality of individual linear bars 44, and these linear bars 44 are placed within the wall 40, and spaced mutually apart within the wall so as to avoid interference with the first and second tab means 21, 31. FIG. 1 clearly illustrates this principal.

Although tab appendages are well known in the art as is illustrated in Schilger, such prior art tabs are taught to extend in the direction of the longitudinal axis of the beam from which they append. In the present invention, the tabs extend laterally with respect to the beam and so are advantageously positioned for transferring the movement of ground or walls directly and more robustly to the beams that form the weight bearing elements in building construction. The disadvantage of longitudinally oriented tabs and flanges imbedded within concrete floor and wall structures was adequately demonstrated in the most recent Northridge, Calif. earthquake where many beams forced cracks and fissures within the concrete structures that held them, and were therefore able to easily slide within these openings to achieve significant movement of building structures within the walls which were required to prevent such movement but could not. Tests by the present inventor has demonstrated clearly that transversely oriented tabs, as claimed in the present invention, are able to provide a significantly superior holding power between moving concrete structures and the beams they support.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A construction system apparatus comprising:

a horizontal first structural beam comprising a vertically oriented first side leg integrally joined to a first base plate, the base plate adapted for abutting a structural ground surface with the first side leg extending upwardly therefrom, the first structural beam further comprising a plurality of horizontally spaced apart, first tabs extending outwardly from the side leg and joined thereto by a vertical bend line;

a vertical second structural beam comprising a second side leg integrally joined to a second base plate, a first end of the second structural beam abutting the first base plate and the first side leg, the second side leg providing a plurality of vertically spaced apart, second tabs extending outwardly therefrom in parallel formation with the first tabs and joined to the second side leg along a horizontal bend line;

the first and the second tabs each derived as a cut-out portion of the first and the second side legs respectively such that a major surface area of each of the first tabs is positioned vertically and a major surface area of each of the second tabs is positioned horizontally; and a vertical concrete wall poured so as to abut the first and the second side legs and embed the first and the second tabs therein such that the concrete wall and the tabs are integral for transferring forces between the concrete wall and the structural beams.

2. The apparatus of claim 1 wherein the first and second tabs are L-shaped.

3. The apparatus of claim 1 wherein the first and second structural beams are U-shaped.

4. The apparatus of claim 1 wherein the concrete wall comprises a rebar network therewithin, the rebar network comprising a plurality of individual linear bars, the linear bars placed and spaced within the concrete wall so as to avoid interference with the first and second tabs.

* * * * *